United States Patent [19]

Hollowell

[11] 3,961,743

[45] June 8, 1976

[54] PLASTIC BAG AND METHOD OF MANUFACTURE

[76] Inventor: John R. Hollowell, 22179 Long Blvd., Dearborn, Mich. 48124

[22] Filed: July 22, 1974

[21] Appl. No.: 490,410

[52] U.S. Cl. ..... 229/62; 206/390; 229/69; 229/DIG. 3

[51] Int. Cl.[2] ..... B65D 33/16

[58] Field of Search ..... 206/390; 229/54 R, 62, 229/69, DIG. 3

[56] References Cited

UNITED STATES PATENTS

| | | | |
|---|---|---|---|
| 3,107,989 | 10/1963 | Fesco | 229/DIG. 3 |
| 3,180,557 | 4/1965 | Thulin | 229/54 R |
| 3,352,411 | 11/1967 | Schwarzkopf | 229/54 R X |
| 3,710,396 | 1/1973 | Tomlinson | 206/390 X |

FOREIGN PATENTS OR APPLICATIONS

| | | | |
|---|---|---|---|
| 1,126,795 | 3/1962 | Germany | 229/54 R |

*Primary Examiner*—Stephen P. Garbe
*Attorney, Agent, or Firm*—Harness, Dickey & Pierce

[57] ABSTRACT

A series of plastic bags are manufactured by extruding the plastic in tubular form and heat-sealing and perforating the flattened tube at spaced intervals. The shape of the heat seal and perforation is such that long ears are formed at opposite ends of the top of each bag. These ears can be tied together to close the bag and form a grasping handle. As illustrated, the ears are formed by folding in the sides of the extruded tube so as to provide a narrower roll, and shifting the layers with respect to each other so that only two ears will be formed on each bag by the heat seal and perforation.

1 Claim, 6 Drawing Figures

PLASTIC BAG AND METHOD OF MANUFACTURE

BACKGROUND OF THE INVENTION

1. Field of the Invention

The invention relates to plastic bags, and particularly to bags fabricated of polyethylene or similar plastics for use as refuse bags and for other purposes. The invention is particularly concerned with the manner of closing and handling these bags as well as their method of manufacture.

2. Description of the Prior Art

Conventionally, large size plastic bags of this type are manufactured by extruding a tube of plastic, expanding the tube with air before the plastic is set, flattening the tube, forming transverse heat seals and adjacent perforations at equally spaced intervals, and rolling up the flattened tube for shipping purposes. The bags are removed one at a time by tearing them off the roll at the perforations.

When each bag is filled, it is necessary to close it by a separate tie. Examples of such ties are shown in Eichler U.S. Pat. No. 2,664,358 and Evans et al U.S. Pat. No. 3,512,700. The use of such ties is disadvantageous; it is necessary in each case to hold the bag closed with one hand while applying the tie with the other. The ties must be stored separately and can be misplaced. With overly full bags, they may be difficult to apply.

Various bag constructions have been proposed incorporating integral tie strips. Among these are Shvetz U.S. Pat. Nos. 3,186,626 and 3,217,971. These prior constructions have certain drawbacks, however. They require an additional act on the part of the handler in tearing away the integral tie strips from the remainder of the bag. They also substantially reduce the useful bag capacity and are not as effective as the present invention in holding the bag completely closed.

Erickson U.S. Pat. No. 3,441,198 shows a flexible bag for packaging foods having ears to facilitate handling as the food item is placed therein. This patent, however, is not believed to teach the claimed invention for reasons which will appear below.

In the bag manufacturing process described above, an intermediate step is often provided during which the sides of the tube are tucked in before the tube is flattened and rolled up, in order to reduce the package size. The illustrated embodiment of the invention is of particular advantage in this type of manufacturing operation.

BRIEF SUMMARY OF THE INVENTION

It is an object of the present invention to provide a novel and improved plastic bag and method of manufacture which overcomes the disadvantages of previous constructions and methods, and permits the bag to be quickly and easily closed and fastened without the necessity of extraneous ties or additional manipulations to form the ties.

It is another object to provide a novel method and construction of this character in which the secured ties hold the bag tightly closed and also may act as a carrying handle.

It is another object to provide an improved method and construction of this nature which is especially adapted for a manufacturing process where the sides of the tube are tucked in to reduce package size.

Briefly, the construction of this invention comprises a tubular plastic bag having a heat seal across one end, a mouth across the other end having a transverse central portion, and a pair of ears at opposite sides of the mouth, said ears being integrally formed with and extending almost at right angles to the central mouth portion, the length of said ears being sufficiently great that they may be brought together and tied so as to close the bag mouth and permit the tied ears to be used as a carrying handle. As illustrated, the bag is formed as part of a tubular strip so that individual bags may be removed along perforations adjacent the sealed bottoms, the latter being complementary to the shape of the mouth and ears. Alternately, the strip can be die cut and the individual bags separated and folded before use.

In essence, the method of this invention comprises the steps of extruding a plastic tube, expanding the tube to the desired bag diameter, flattening the tube, and forming transverse heat seals and adjacent perforations at equally spaced intervals along the tube, each seal and perforation comprising a transverse central portion and ear portions almost at right angles to the central portion, whereby as each bag is torn off the roll, the next bag will be formed with ears which are long enough to be tied together to close the bag and act as a carrying handle. Further, the invention comprises the intermediate step of tucking in the sides of the tube before it is flattened to form inward folds with layers on opposite sides thereof, transversely shifting the layers a predetermined distance so that their outer areas of the layers are exposed in opposite directions, and forming the said ear portions of the heat seals and perforations only in said exposed areas.

BRIEF DESCRIPTION OF THE DRAWINGS

FIG. 4 is a perspective view of the bag after the central portion of the mouth has been folded in;

DESCRIPTION OF THE PREFERRED EMBODIMENTS

Figure 1:
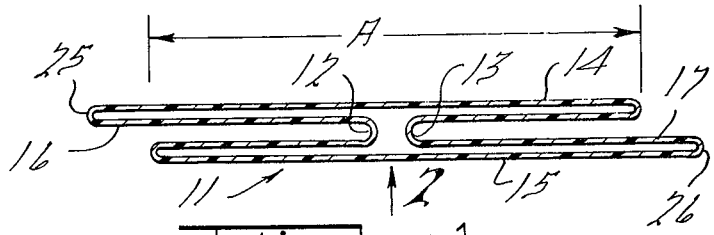
FIG. 1 is a cross-sectional view of the tube after it has been flattened, its sides tucked in, and the upper and lower layers shifted transversely with respect to each other.

Referring first to the embodiment of FIGS. 1 through 5, the reference numeral 11 indicates generally an extruded tube of plastic which has been expanded to form the desired bag diameter, for example by the method described above. The sides of the tube have been tucked in as indicated at 12 and 13, and the tube has been flattened. According to the invention, the upper layer 14 of the tube is shifted transversely with respect to the lower layer 15 so that a portion 16 along one side of the upper layer is exposed in one direction and the opposite portion 17 of the lower layer is exposed in the opposite direction. The amount of shifting may vary with requirements. As a typical example, however, the exposed areas 16 and 17 along the outer edges of the layers may be 1 ½ inches wide and the common or overlapping area A of the two layers may be 19 inches wide.

After this shifting has been accomplished, heat seals generally indicated at 18 and adjacent perforations generally indicated at 19 may be applied at equally spaced intervals along the strip. Each seal 19 and its corresponding perforation 19 have central portions 21, 22 which are perpendicular to the tube axis and extend across at least the overlapping area A between the two folds 14 and 15. The side or ear portions 23 and 24 of each seal and perforation are almost at right angles to central portions 21 and 22 and are inclined outwardly toward the layer edges 25 and 26. In order to prevent tearing, the junctures of the central and ear portions of the perforations are not sharp but are filleted as indicated at 27.

After the heat seals and perforations have been made, strip 11 is rolled up into a package (not shown). To remove a bag from the roll it is merely necessary to tear along a perforation 19 so that heat seal 18 forms the bottom of the bag being removed. The first bag on a roll will have a mouth shaped like perforation 19 but no adjacent heat seal. Each time a bag is removed, the next bag will automatically be formed with ears 28 and 29 for tying purposes. When each bag is removed and opened up, it will look like FIG. 3, where the separate bag is generally indicated at 30. Ears 28 and 29 are long enough to permit them to be tied together in a manner about to be described.

Figure 4:
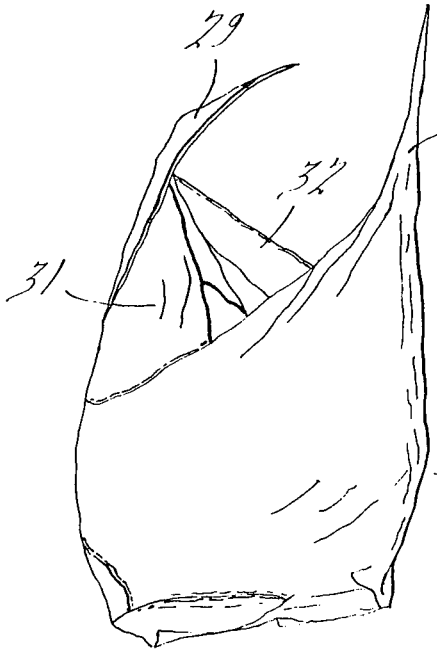
Figure 5:
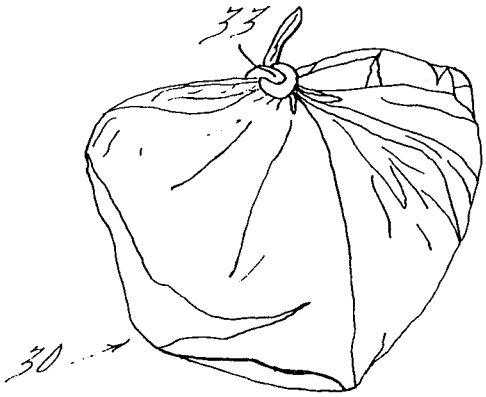
FIG. 5 is a perspective view of the bag after the ears have been tied together.

After the bag 30 is filled its mouth portions 31 and 32 between tails 28 and 29 will be folded inwardly as shown in FIG. 4. The ears may then be brought together and tied, for example in a square knot 33 as shown in FIG. 5. The tied ears will hold down inwardly folded portions 31 and 32 and the bag will be completely closed. A person's hand may be slipped under knot 33 so that the tied ears act as a carrying handle for the bag.

It will be observed with respect to the manufacture of the bags that, due to the relative dimensions of the central and ear portions of the heat seals and perforations, only two ears will be formed on each bag when the perforations are separated.

Figure 2:
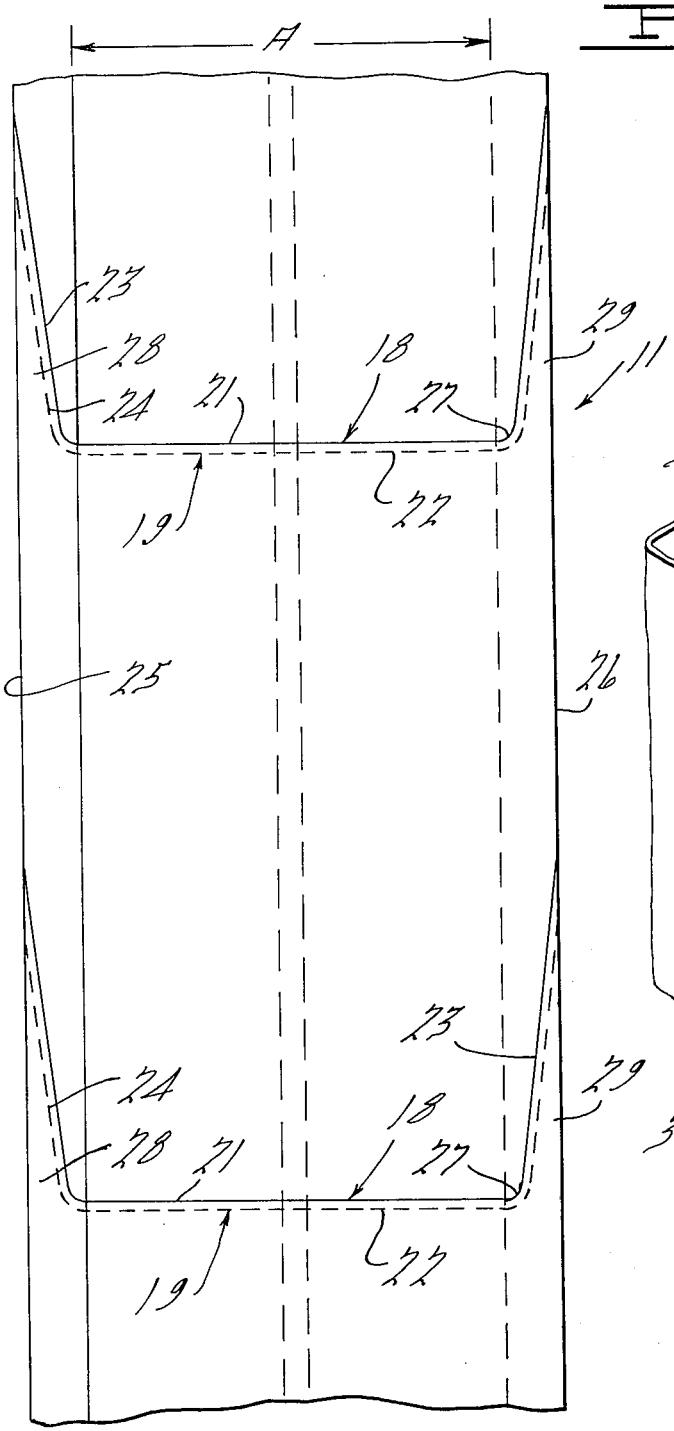
FIG. 2 is a fragmentary plan view of the flattened tube strip taken in the direction of arrow 2 of FIG. 1 and showing the locations and shapes of the heat seals and perforations.
Figure 3:
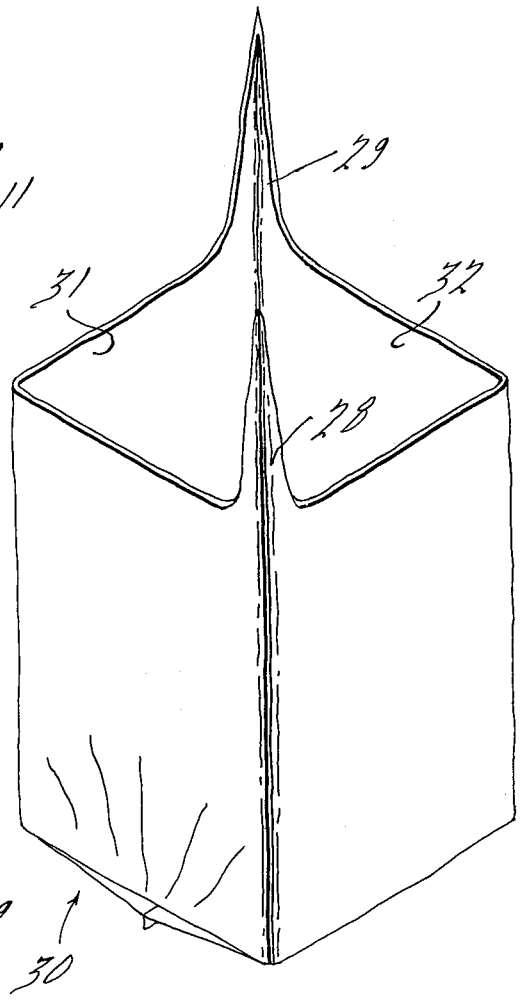
FIG. 3 is a perspective view of the bag after it has been removed and opened.
Figure 6:
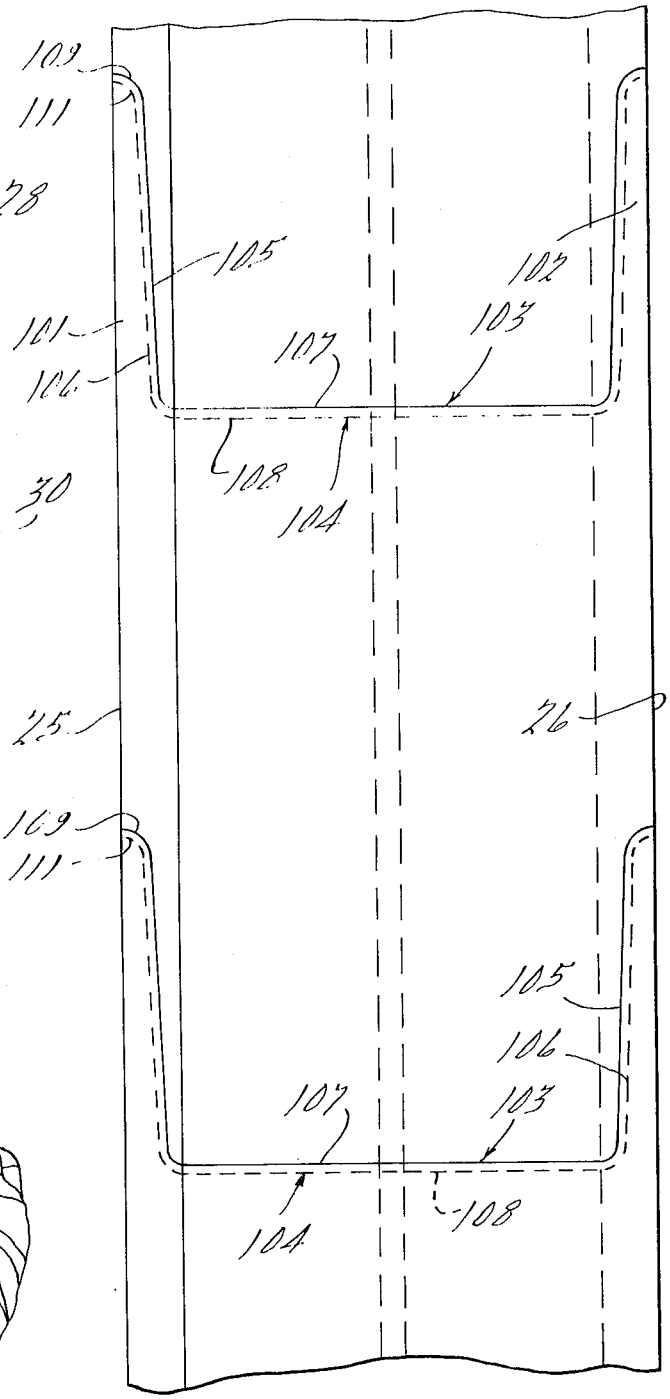
FIG. 6 is a fragmentary plan view of a bag strip showing an alternate form of the heat seal and perforations.

FIG. 6 illustrates another configuration of the ear portions. These portions are indicated at 101 and 102 and are formed by heat seals generally indicated at 103 and perforations generally indicated at 104. The ear portions 105 and 106 of the heat seals and perforations extend substantially at right angles to the central portions 107 and 108, rather than being inclined as shown in FIG. 2. The outer ends 109 and 111 of the heat seals and perforations are curved outwardly and approach side edges 25 and 26 of the bag layers at approximately right angles. The result will be that when each bag is opened up, the ears 101 and 102 will be wider and rounded at their outer ends, rather than pointed as in the previous embodiment.

I claim:

1. A flattened tubular plastic strip formed so that individual bags may be removed therefrom, comprising a plurality of heat seals and adjacent parallel perforations formed at equally spaced intervals along said strip, each heat seal and perforation having a central portion extending transversely across most of said strip, and ear portions extending almost at right angles to said central portions until the edges of said strip, whereby the bottom of each bag has a central portion extending straight across the bag for almost its entire width to maximize bag capacity, the length of said ear portions being sufficient to form ears which may be tied together to close each bag after it is removed along a perforation from the strip, the sides of said strip being tucked in to form two inward folds with strip layers on opposite sides thereof, the layers being partially offset so that outer areas of the layers are exposed in opposite directions, the transverse central portions of said heat seals and perforations extending at least to said exposed areas, the ear portions and the junctures between the ear and central portions of said heat seals and perforations being formed only in said exposed areas.

* * * * *